US005642674A

United States Patent [19]

Joye, Sr. et al.

[11] Patent Number: 5,642,674

[45] Date of Patent: Jul. 1, 1997

[54] PORTABLE EATING TABLE

[75] Inventors: Freddie W. Joye, Sr., Waynesboro; Lane I. Spector, Gladwyne, both of Pa.

[73] Assignee: Fredlane Enterprises, Inc., Waynesboro, Pa.

[21] Appl. No.: 664,563

[22] Filed: Jun. 17, 1996

[51] Int. Cl.[6] ..... A47B 23/00

[52] U.S. Cl. ..... 108/43; 108/25

[58] Field of Search ..... 108/43, 44, 45, 108/25

[56] References Cited

U.S. PATENT DOCUMENTS

| | | | |
|---|---|---|---|
| 1,191,425 | 7/1916 | Huddle . | |
| 1,232,089 | 7/1917 | Riebe . | |
| 1,542,163 | 6/1925 | Morde | 108/43 X |
| 2,289,945 | 7/1942 | Wadsack . | |
| 3,009,613 | 11/1961 | Noland . | |
| 3,541,976 | 11/1970 | Rozas | 108/43 |
| 4,946,094 | 8/1990 | Stang . | |
| 5,060,581 | 10/1991 | Malinski | 108/44 |
| 5,062,558 | 11/1991 | Stang . | |
| 5,074,222 | 12/1991 | Welch . | |
| 5,188,421 | 2/1993 | Arseneault | 108/44 X |
| 5,221,032 | 6/1993 | Bott et al. . | |
| 5,285,940 | 2/1994 | Goulter . | |
| 5,328,070 | 7/1994 | Lavi . | |
| 5,421,499 | 6/1995 | Bauer | 108/43 X |

FOREIGN PATENT DOCUMENTS

| | | | |
|---|---|---|---|
| 107013 | 11/1923 | Switzerland | 108/43 |

*Primary Examiner*—Jose V. Chen
*Attorney, Agent, or Firm*—George C. Atwell

[57] ABSTRACT

A portable eating table is provided for securement to a user's neck whereupon the portable eating table is pendent therefrom and can support and hold articles, such as food and beverage items and eating utensils, thereon so that the user's hands are free for other purposes, and includes a foldable main body member comprising a first article supporting portion which rests against the user's chest and a second article supporting portion attached to the first article supporting portion and which can pivot to or away from the first article supporting portion. In order to provide rigidity and stability to the first and second article supporting portions, flat insert members are insertable into respective insert pocket members of the first and second article supporting portions. The main body member includes a front side, a back side, and a transverse rear slit on the back side which forms the pocket members and through which the insert members can be slid for enclosure and containment within the respective pocket members. The first and second article supporting portions can be folded together so that they are contiguous to each other in order to create a seat for the user.

12 Claims, 3 Drawing Sheets

PORTABLE EATING TABLE

BACKGROUND OF THE INVENTION

The present invention relates to devices attachable to individuals for supporting articles in order to free their hands for other purposes, and more particularly pertains to a portable eating table suspended from the user's neck for supporting food and beverage items and utensils thereon.

At any large gathering or social event, such as a wedding reception, bar mitzvah, baptism, family reunion, birthday, outdoor picnic, sporting event, military exercise, etc., where food is served at buffet tables, picnic tables, chow lines, or food kiosks, the individuals must stand in line and hold a plate with one hand while using the other free hand to scoop food onto the plate with a utensil or place food items onto the plate. The individuals must maintain a balancing act in that utensils and perhaps a beverage item may be set on the plate and must be carefully balanced thereon while at the same time food items are being placed on the plate by the individuals as they pass through the food lines. Also, individuals confined to wheelchairs must overcome the problem of balancing the food plate in one hand, using the other hand to place food and beverage items on the plate, and maneuvering the wheelchair around crowds of people and over uneven terrain.

Furthermore, this activity is made more difficult when families with children, especially young children, must go through a buffet line at a wedding reception, wait in long lines before ordering food at food kiosks in sports arenas and stadiums, or stand in line beside picnic tables laden with food at an outdoor party. The adults must not only load food and beverage items onto their plates but, at the same time, balance their own plates with one hand while placing food and beverage items on their children's plates with the other free hand. Sometimes the balancing act takes the form of the adult holding and balancing both his or her plate and one child's plate between the fingers of one hand while using the other free hand to place or scoop food and beverage items onto both plates. The adult must accomplish this task while keeping the children under control and preventing the plates from tipping or overturning and thus spilling their contents.

The problem of balancing one or more plates or trays with one hand while placing food and beverage items thereon with the other hand is encountered in such widely varying situations as fathers waiting in line with their sons before food kiosks at sporting arenas and stadiums and by soldiers standing in line at the field mess attempting to place food on their trays while preventing their helmets from falling off as they reach for the food and beverage items. Moreover, at events where there are not enough chairs or seats, or in military situations where there is only the cold, wet ground to sit on, there is the additional problem of holding the plate or tray steady with one hand and manipulating eating utensils with the other hand, while preventing items from falling to the ground. Even when seats are available at sports arenas and stadiums, there is still the problem of holding food and beverage items in one or both hands and following the course of the game while spectators are standing, cheering, jostling one another, and continuously moving about during the game. Placing the food or beverage items in the lap and/or on the seat to free one or both hands is no solution because the constant moving and jostling by the individual, or by adjacent individuals, invariably causes the food and beverage items to spill on the individual's lap. It is not enjoyable watching a football game outdoors on a cold December afternoon with food and beverage items spilled on your lap and permeating your clothing.

A number of devices have been invented which attach to the individual's neck and/or waist and in or upon which food and beverage items, and utensils, are placed so that the individual can eat while both hands are free. Among the devices are the following: U.S. Pat. No. 1,191,425 (Huddle); U.S. Pat. No. 1,232,089 (Riebe); U.S. Pat. No. 2,289,945 (Wadsack); U.S. Pat. No. 3,009,613 (Noland); U.S. Pat. No. 4,946,094 (Stang); U.S. Pat. No. 5,062,558 (Stang); U.S. Pat. No. 5,074,222 (Welch); U.S. Pat. No. 5,221,032 (Bott et al.); U.S. Pat. No. 5,285,940 (Goulter); U.S. Pat. No. 5,328,070 (Lavi). These devices have a number of disadvantages and defects; among them the fact that they are awkward in their attachment to the user, uncomfortable to wear, and not capable of easy storage and movement to different locations. Therefore, there is a need for a holder or food tray device which overcomes these defects and also permits easy cleaning and can be used by both adults and children.

SUMMARY OF THE INVENTION

The present invention comprehends a portable eating table for supporting and holding a variety of articles, such as food and beverage items and eating utensils, so that the user's hands can remain free for eating or for other purposes while the articles remain stationary on the portable eating table.

The portable eating table is attached to the user's neck and is pendent therefrom so that a portion of the eating table rests against the user's chest area.

Specifically, the portable eating table includes a main body member which is attached to the user's neck and is pendent therefrom. When disposed in the use position from the user's neck, the main body member has an L-shaped configuration, and the main body member defines a generally vertically-disposed first article supporting portion pivotably attached to a generally horizontally-disposed second article supporting portion. The first article supporting portion rests against the user's chest area while the second article supporting portion projects outwardly away from the user's chest area. Moreover, the main body member is formed from a rectangular-shaped covering member comprised of a one-piece, long-lasting, washable, pliable, cloth-type material. The first and second article supporting portions are defined, by the main body member and the main body member includes a front side, a back side, and a rear slit that is centrally positioned on the back side and extends transversely across the main body member, thus dividing the back side of the main body member into a first insert pocket member and a second insert pocket member. The pocket members are generally equal in size and comprise the entire rear side of the covering member.

The main body member as formed by the covering member is flexible and pliable and, in order to support articles thereon, the first and second article supporting portions must be provided with structural elements that create a planar shape and provide dimensional stability to the article supporting portions. This is accomplished by having a first flat insert member removably insertable within the first insert pocket member and having a second flat insert member removably insertable within the second insert pocket member. The first pocket member is part of the first article supporting portion and the second pocket member is part of the second article supporting portion; and, after the insert members are disposed within the respective pocket members, a closure means on the transverse edges of both pocket members is used to attach and close the edges of the pocket members together to prevent the insert members from falling out of the pocket members.

When the main body member is disposed in the use position pendent from the user's neck with the first supporting portion resting against the user's chest area, the second supporting portion is pivoted away from the first supporting portion so that the second supporting portion projects outwardly and away from the user's chest area. In order to prevent the articles from sliding off the second article supporting portion when the main body member is disposed in the use position, a pair of straps are attached to the edges of the first and second article supporting portions to limit the pivotable movement of the second article supporting portion from the first article supporting portion. The straps restrict the pivotable movement of the second article supporting portion within an angle not greater than 90° with respect to the first article supporting portion. This provides the second supporting portion with a slight upward tilt or slope which prevents articles from sliding off the second supporting portion which would occur if the second supporting portion could pivot at an angle of 90° or more with respect to the first article supporting portion.

It is an objective of the present invention to provide a portable eating table which is usable in a wide variety of settings and situations, and is easily transportable and storable.

It is another objective of the present invention to provide a portable eating table which is lightweight, easy to clean, durable, and can be used by children as well as adults.

Still another objective of the present invention is to provide a portable eating table which can be folded together to form a seat for an individual.

The foregoing and other objects and advantages, when taken in conjunction with the following detailed description and accompanying drawings, illustrate the preferred embodiment of the invention.

DETAILED DESCRIPTION OF THE PREFERRED EMBODIMENT

Figure 3:
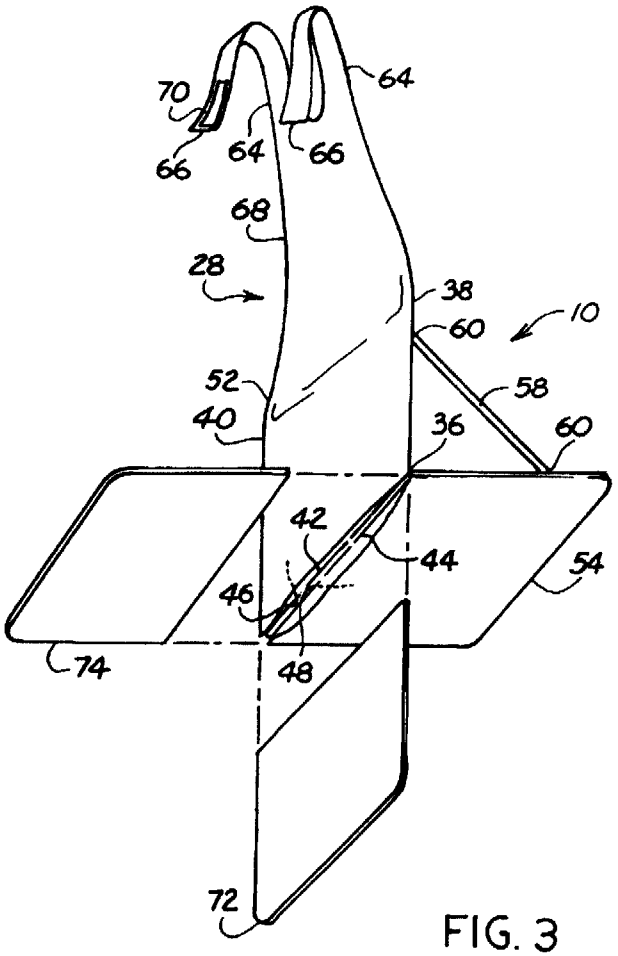
FIG. 3 is a right side perspective view of the embodiment first shown in FIG. 1 illustrating structural elements which give the portable eating table shape and dimensional stability.
Figure 2:
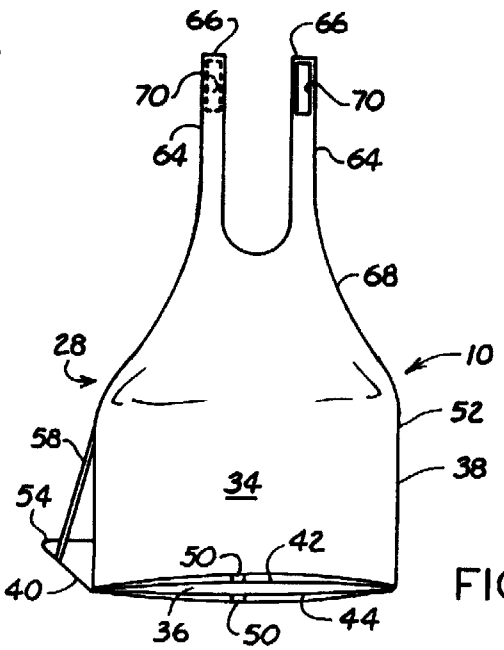
FIG. 2 is a perspective view of the embodiment first shown in FIG. 1 illustrating the back side of the portable eating table.
Figure 1:
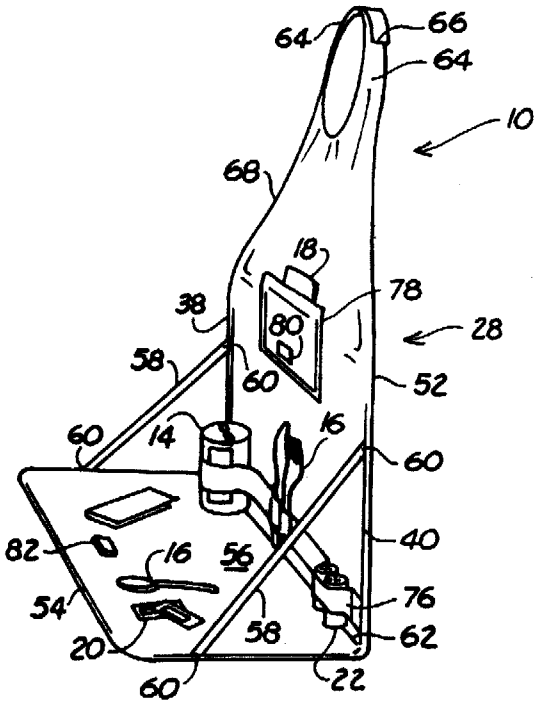
FIG. 1 is a perspective view of the preferred embodiment of a portable eating table illustrating the use position and articles being supported thereon.
Figure 8:
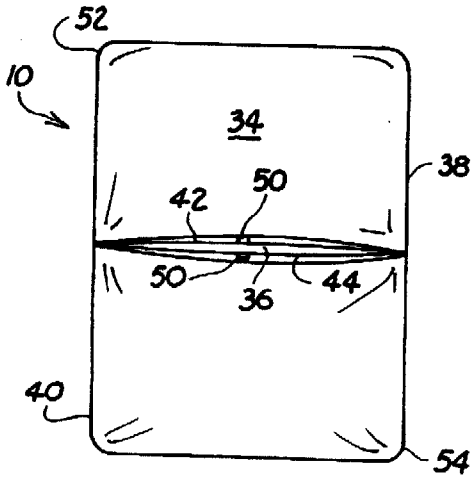
FIG. 8 is a rear elevational view of the embodiment first shown in FIG. 1.
Figure 5:
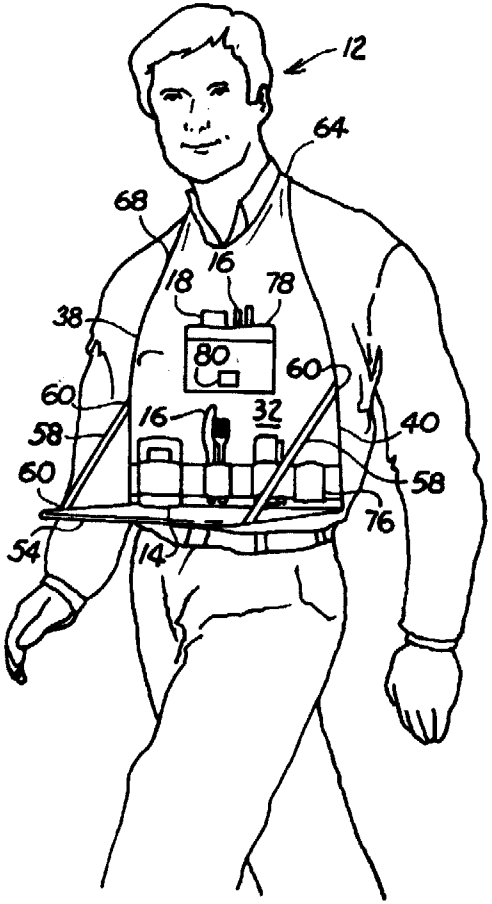
FIG. 5 is a perspective view of the embodiment first shown in FIG. 1 showing the eating table suspended from a user's neck.
Figure 4:
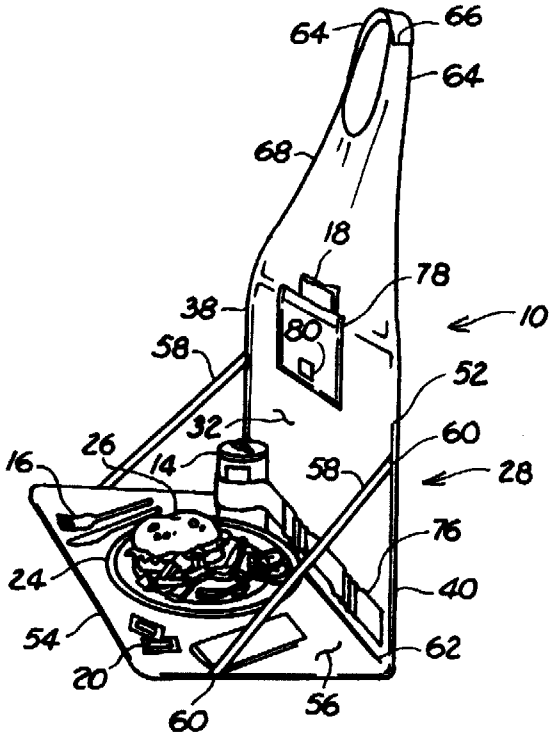
FIG. 4 is a perspective view of the embodiment first shown in FIG. 1 illustrating a variety of food articles and items being supported and held thereon.

Referring to FIGS. 1–8, there is shown a portable eating table 10 which is attached to the neck of a user 12 so that in the use position the table 10 is suspended therefrom and extends downward to the area adjacent the user's waist. The table 10 is designed to assist persons who are eating outside but need to keep their hands free for other purposes, and this task is accomplished by permitting a variety of articles to be supported thereon when the table 10 is disposed in the use position. As shown in FIGS. 1, 4, and 5, articles that can be supported on or by the table 10 include beverage containers 14, eating utensils 16, napkins 18, condiment containers 20, salt and pepper shakers 22, and plates 24 with food 26 placed thereon. In addition, a variety of items including but not limited to cigarette lighters, cigarette packs, pencils, felt tip markers, combs, hairbrushes, scissors, and small knives, such as penknives, etc., can also be supported or held on the table 10. Moreover, as will be more fully explained hereinafter, the table 10 has a dual purpose in that it can also be used as a soft, moisture-resistant seat for the user 12 when it is not needed to support and hold articles thereon. In addition, the table 10 can be used by a passenger in a car or motor vehicle to support food items thereon and prevent them from spilling while the vehicle is moving. The table 10 is lightweight and easy to transport and store and is, therefore, usable in a wide range of settings and situations.

Figure 7:
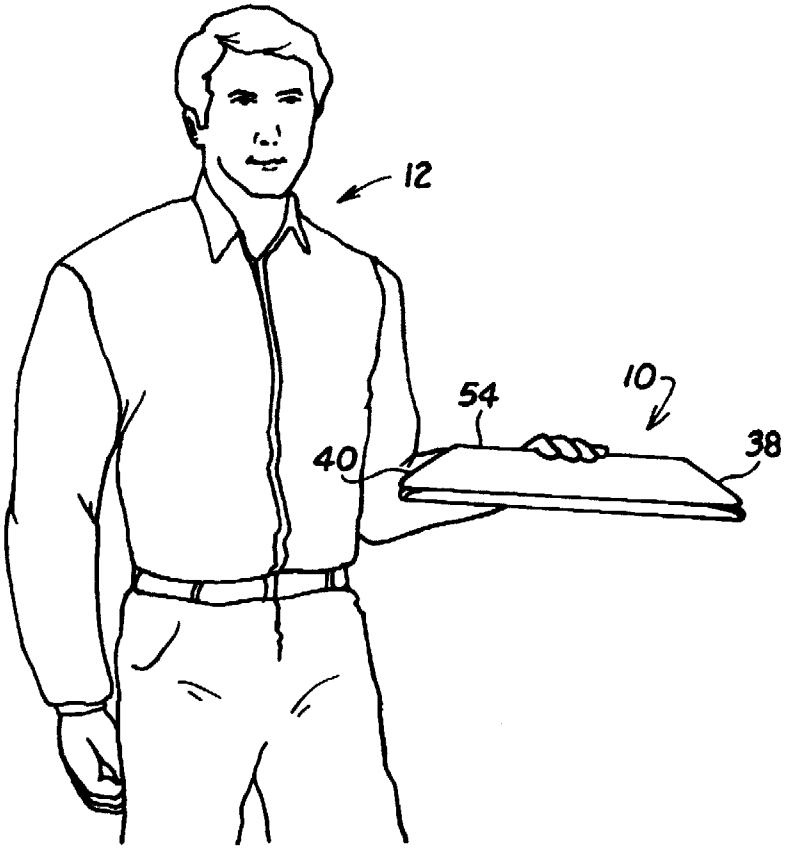
FIG. 7 is a front perspective view of the embodiment first shown in FIG. 1 illustrating the eating table in the completely closed disposition for use as a seat.
Figure 6:
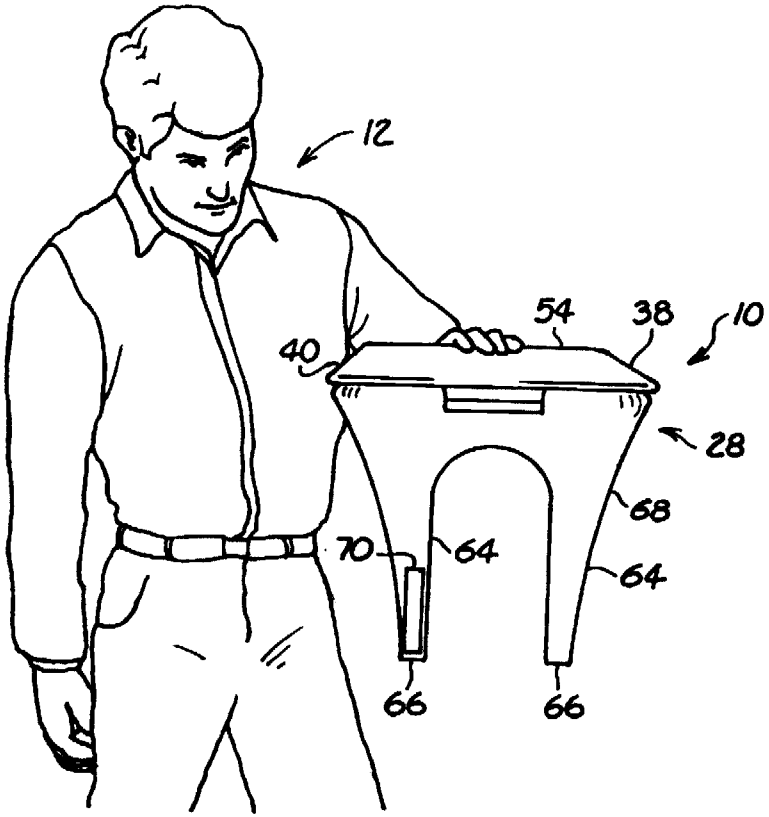
FIG. 6 is a front perspective view of the embodiment first shown in FIG. 1 illustrating the eating table held by the user in the closed non-use position.

As shogun in FIGS. 1–5 and 8, the table 10 includes a main body member 28 which, in the use position, is pendent from the user's neck. When the main body member 28 is disposed in the use position, as shown in FIGS. 1, 2, 4, and 5, the main body member 28 defines an L-shaped configuration; in the non-use disposition, as shown in FIGS. 6 and 7, the main body member 28 can be folded for storage, transportation to another location, or for use as a seat by the user 12. The main body member 28 is defined by a covering member 30 which is preferably manufactured from a water-resistant material that permits easy wiping to clean messes and spills. A cotton/polyester blend material would be preferable and would be less expensive to produce and would allow the user to easily wash the covering member 30 after removal of elements hereinafter further described. The covering member 30 can come in a wide range of colors; and when the table 10 is used in military settings, the covering member 30 can be in camouflage hues.

The main body member 28 includes a front side 32 which faces outward and away from the user's chest area, a back side 34 which rests against the user's chest and abdomen when the table 10 is attached to the user's neck, and a rear slit 36 which is located on the back side 34 of the main body member 28. The rear slit 36 extends transversely across the back side 34 from one long edge 38 to a second long edge 40. A pair of transverse edges 42 and 44 are defined and formed by the rear slit 36, and the back side 34 also includes a rear slit closure means which will be more fully described hereinafter. Dividing the back side 34 by the rear slit 36 creates a first insert pocket member 46 and a second insert pocket member 48, both of which are located on and substantially comprise all the area of the back side 34. Both pocket members 46 and 48 are generally rectangular-shaped and are capable of receiving and holding therein structural elements which will be hereinafter further described. The rear slit closure means includes a pair of fastener tabs 50, such as those which are made from the material commonly known as VELCRO, with one tab 50 attached to the edge 42 of pocket member 46 and the other tab 50 attached to the edge 44 of pocket member 48. The tabs 50 are attached to the center of the respective edges 42 and 44 and opposite one another. When the tabs 50 are pressed together, the rear slit 36 is closed and the elements contained within the pocket members 46 and 48 are prevented from sliding or falling out.

As shown in FIG. 5, when the main body member 28 is disposed in its operative position pendent from the user's neck, the main body member 28 is generally L-shaped and defines a first article supporting portion 52 and an integrally-attached second article supporting portion 54, and both portions 52 and 54 are capable of supporting and holding articles thereon. The first front side and the first back side of portion 52 is commensurate with the front side 32 and back side 34 of the main body member 28, and the second front side and second back side of portion 54 is commensurate with the front side 32 and the back side 34 of the main body member 28. In addition, portion 54 includes an upper article receiving surface 56 upon which articles, such as those shown in FIGS. 1, 4, and 5, are placed. The surface 56 is also commensurate with the front side 32 of the main body member 28. When the main body member 28 is suspended from the user's neck in a social setting, such as at an outdoor picnic, wedding, or military field exercise, the back side 34 of portion 52 rests against the user's chest area and portion 54 pivots away from portion 52. When portion 54 is pivoted its maximum extent away from portion 52, portion 54 is disposed in its use position for receiving and supporting articles thereon as shown in FIGS. 1, 4, and 5.

An attachment means is used to delimit the range of pivotable movement of portion 54 with respect to portion 52 when the main body member 28 is suspended from the user's neck. As shown in FIGS. 1–6, the attachment means includes a pair of spaced-apart, flexible, elongated straps 58; and each strap 58 includes a pair of opposed strap ends 60 which are secured to each edge 38 and 40 of the main body member 28. Moreover, the opposed edges 38 and 40 are commensurate with the edges of portions 52 and 54 and, when the main body member 28 is disposed in the use position, as shown in FIGS. 1, 4 and 5, the ends 60 are attached to the respective edges 38 and 40 of the main body member 28 approximately two-thirds of the distance from a transversely-extending fold or crease 62 which defines the pivot point of the main body member 28. The length of the straps 58 and the point at which the ends 60 are secured to the edges 38 and 40 restricts the pivotable movement of portion 54 to an angle of not greater than 90° with respect to portion 52 when the main body member 28 is attached to the user's neck for suspension therefrom. Extending or shortening the length of both straps 58 and changing the point at which the ends 60 are attached to the edges 38 and 40 will change the angle at which portion 54 can pivot with respect to portion 52. In no event should portion 54 be allowed to pivot from portion 52 at an angle greater than 90° when the table 10 is disposed in the use position; when the main body member 28 is attached to and suspended from the user's neck, and the user 12 is standing upright, portion 54 will pivot to the use position so that the angle between portions 52 and 54 will be close to a right angle. To prevent articles placed on receiving surface 56 from sliding off, portion 54 pivots at a slight bevel or cant with respect to portion 52 so that receiving surface 56 tilts slightly upward toward the user's chest area and neck. If portion 54 pivoted from portion 52 at an angle greater than 90°, articles would slide right off receiving surface 56. It is the length of the straps 58 and the point of attachment of the ends 60 to the edges 38 and 40 which give portion 54 a slight bevel or cant with respect to portion 52 when both portions 52 and 54 are disposed in the use position.

As shown in FIGS. 1–6, a neck support means is used to suspend the main body member 28 from the user's neck. The neck support means includes a pair of elongated, spaced-apart neck straps 64 which are capable of encircling the user's neck so that neck strap ends 66 can be secured to each other at the back of the user's neck. The neck straps 64 are integrally attached to and project from a generally triangular-shaped bib portion 68 of the main body member 28. The bib portion 68 is integrally formed from and extends outwardly from portion 52 and, when the main body member 28 is pendent from the user's neck, the bib portion 68 rests against the user's upper chest area and portion 52 rests against the user's lower chest and stomach area. Each neck strap 64 includes a fastener strip 70 of predetermined length, and the strips 70 are attached to opposite sides of the neck strap ends 66 so that the neck straps 64 do not have to be twisted as they pass behind the user's neck to properly position the strips 70 opposite to each other. The strap ends 66 are pressed together for securement and, thus, adhesion of the strips 70 to each other attaches the table 10 to the user's neck. The fastener strips 70 are also manufactured from the material commonly known as VELCRO.

As shown in FIG. 3, a supporting portion stabilizing means is used to give shape and stability to portions 52 and 54. The main body member 28 is formed by the covering member 30, and the covering member 30 is simply a flexible and pliable cloth-type material and, therefore, the main body member 28 lacks the ability to assume the definite L-shaped configuration of FIGS. 1–5. This is remedied by the use of the supporting portion stabilizing means shown in FIG. 3. More specifically, the stabilizing means includes a first flat, generally rectangular-shaped insert member 72 and a second flat, generally rectangular-shaped insert member 74 which are removably insertable into portions 52 and 54, respectively. The insert members 72 and 74 can be manufactured from a cardboard or plastic material and are disposed within portions 52 and 54 by first laying the main body member 28 on its front side 32 on a flat surface, and then opening the rear slit 36 so that insert member 72 can be slid within pocket member 46, and insert member 74 can be slid within pocket member 48. Both pocket members 46 and 48 are large enough to fully contain insert members 72 and 74. When both insert members 72 and 74 are fully inserted within respective pocket members 46 and 48, the tabs 50 on the edges 42 and 44 of the rear slit 36 are adhered together, and insert members 72 and 74 are held within pocket members 46 and 48 and prevented from falling out when the table 10 is attached to the user's neck. The disposition of insert members 72 and 74 within pocket members 46 and 48 creates a planar shape for portions 52 and 54 and provides dimensional stability to portions 52 and 54. When required, the tabs 50 of the rear slit 36 can be opened and insert members 72 and 74 can be easily and quickly removed from pocket members 46 and 48 so that the table 10 can be washed and cleaned. If necessary, insert members 72 and 74 can be cleaned and washed separately and then inserted back into respective pocket members 46 and 48 if the insert members 72 and 74 are manufactured from plastic.

As shown in FIGS. 1 and 4–7, the table 10 includes several other features which enhance its usefulness. The table 10 includes a stretchable and flexible elongated article support band 76 which is attached to the front side of portion 52 adjacent the fold or crease 62 of the main body member 28. In the present invention, the band 76 extends transversely from edge 38 to the opposite edge 40 of the main body member 28. The band 76 comprises an elastic material which is sewn to the front side but, at certain places along its length, can be pulled and stretched away from the front side of portion 52 so that a variety of articles, such as articles 14–22 of FIGS. 1, 4, and 5, can be slipped or inserted between the stretchable portions of the band 76 and the front side of portion 52. In FIG. 1 the band 76 is shown holding the beverage container 14, eating utensils 16, and salt and pepper shakers 22 against the front side of portion 52; in FIG. 4 the band 76 is shown firmly holding two beverage containers 14. In addition, a pocket 78 is attached to the front side of portion 52 above the band 76 and at the rough boundary between portion 52 and bib portion 68. Any number of articles can be stored within the pocket 78; in FIGS. 1 and 4 the pocket 78 is shown holding a napkin 18, while in FIG. 5 the pocket 78 is shown holding a napkin 18 and eating utensils 16.

As shown in FIGS. 1 and 4–7, a supporting portion closure means is used to maintain the closed, contiguous relationship of portions 52 and 54 to each other when the table 10 is folded together for storage, transport to another site, or for use as a seat. The supporting portion closure means includes a first fastener tab 80 attached to the pocket 78 and a second fastener tab 82 attached to the receiving surface 56 of portion 54. Both tabs 80 and 82 are composed of the material con, only known as VELCRO. When the table 10 is used as a seat, or when the table 10 is stored or transported to another site, the neck straps 64 and the bib portion 68 are folded onto the front side of portion 52, making sure that tab 80 is not covered, and then portions 52 and 54 are folded together so that the tabs 80 and 82 adhere to each other and maintain the closed disposition of the table 10. The table 10 can then be used as a seat. Furthermore, it is possible to walk with the table 10 still pendent from the user's neck. The user simply removes the bulky items from the front side 32 and folds portion 54 to portion 52 attached and contiguous to portion 52. The seated individual can get up from his or her seat and safely walk around or up and down stairs while maintaining the ability to see objects adjacent his or her feet.

FIG. 6 shows the table 10 closed with the neck straps 64 and the bib portion 68 hanging down; and FIG. 7 shows the table 10 completely closed with the neck straps 64 and the bib portion 68 folded within and enclosed by portions 52 and 54.

A preferred embodiment of the invention has been disclosed in the specification and drawings and, although specific terms are employed, they are used in a generic and descriptive sense only and not for purposes of limitation, the scope of the invention being set forth in the following claims.

We claim:

1. A portable eating table for supporting and holding articles and which is pendent from a user's neck and rests against the user's chest when disposed in the operative position, comprising:

a first article supporting portion for holding articles and having a first front side and a first back side;

a second article supporting portion having a second front side and a second back side and pivotably attached to the first supporting portion so that the second supporting portion can support articles thereon when pivoted away from the first supporting portion;

a rear slit which divides the first back side into a first pocket member for the first article supporting portion and which divides the second back side into a second pocket member for the second article supporting portion;

a first flat insert member for disposition within the first pocket member for creating a planar shape and providing dimensional stability to the first article supporting portion;

a second flat insert member for disposition within the second pocket member for creating a planar shape and providing dimensional stability to the second article supporting portion; and attachment means for delimiting the pivotable movement of the second article supporting portion from the first article supporting portion.

2. The portable eating table of claim 1 further comprising a stretchable article support band attached to the first supporting portion for receiving articles therein and holding the articles between the stretchable support band and the first supporting portion.

3. The portable eating table of claim 1 further comprising a rear slit closure means for closing the first and second insert pocket members and thus preventing the first and second insert members from falling out of the respective insert pocket members.

4. The portable eating table of claim 1 wherein the attachment means includes a pair of spaced-apart flexible elongated straps having opposed strap ends which are attached to the first and second supporting portions for delimiting the pivotable movement of the second supporting portion from the first supporting portion.

5. The apparatus of claim 4 wherein the second supporting portion pivots from the first supporting portion within an angle of less than or equal to 90° when the first supporting portion is disposed pendent from the user's neck and the second supporting portion is disposed in the operative position.

6. The portable eating table of claim 1 further comprising a supporting portion closure means for permitting the closure of the first supporting portion contiguous to the second supporting portion so that the first and second supporting portions can be folded together when not disposed in their operative positions.

7. A portable eating table for suspension from the neck of a user and resting against the user's chest so that articles can be supported and held thereon, the portable eating table comprising:

a main body member having a front side and a back side for suspension from the user's neck and further defining a generally vertically-disposed first article supporting portion and a generally horizontally-disposed second article supporting portion attached to the first article supporting portion;

the second article supporting portion capable of pivotable movement to or away from the first article supporting portion and further defining a flat receiving surface upon which articles are supported;

the main body member further characterized by a transversely-extending rear slit which divides the back side and creates a first pocket member for the first article supporting portion and a second pocket member for the second article supporting portion;

a pair of removably insertable flat insert members for disposition within, respectively, the first and second pocket members so that a planar shape with dimensional stability can be created for the first and second article supporting portions;

a stretchable article support band attached to the first supporting portion for receiving articles therein and holding the articles between the stretchable support band and the first supporting portion; and attachment means for limiting the pivotable movement of the second article supporting portion from the first article supporting portion.

8. The portable eating table of claim 7 further comprising a rear slit closure means for closing the first and second insert pocket members and thus preventing the first and second insert members from falling out of the respective insert pocket members.

9. The portable eating table of claim 7 wherein the attachment means includes a pair of spaced-apart flexible elongated straps having opposed strap ends which are attached to the edges of the first and second supporting portions for delimiting the pivotable movement of the second supporting portion from the first supporting portion.

10. The apparatus of claim 9 wherein the second supporting portion pivots from the first supporting portion within an angle of less than or equal to 90° when the first supporting portion is suspended from the user's neck and the second supporting portion is disposed in the operative position.

11. The portable eating table of claim 10 further comprising a supporting portion closure means for permitting the closure of the first supporting portion contiguous to the second supporting portion so that the first and second supporting portions can be folded together when not disposed in their operative positions.

12. A portable eating table for supporting and holding articles and which is pendent from a user's neck and rests against the user's chest so that the articles can be supported and held thereon, the portable eating table comprising:

a main body member having a front side and a back side for suspension from the user's neck and further defining a generally vertically-disposed first article supporting portion and a generally horizontally-disposed second article supporting portion attached to the first article supporting portion;

the second article supporting portion pivotably attached to the first article supporting portion and further defining a flat receiving surface upon which articles are supported;

the main body member further characterized by a transversely-extending rear slit which divides the back side and creates a first pocket member for the first article supporting portion and a second pocket member for the second article supporting portion;

a first flat insert member for insertion within the first pocket member for creating a planar shape and providing dimensional stability to the first article supporting portion;

a second flat insert member for insertion within the second pocket member for creating a planar shape and providing dimensional stability to the second article supporting portion; and attachment means for limiting the pivotable movement of the second article supporting portion from the first article supporting portion.

* * * * *

UNITED STATES PATENT AND TRADEMARK OFFICE

CERTIFICATE OF CORRECTION

PATENT NO. : 5,642,674

DATED : July 1, 1997

INVENTOR(S) : FREDDIE W. JOYE SR. and LANE I. SPECTOR

It is certified that error appears in the above-indentified patent and that said Letters Patent is hereby corrected as shown below:

Column 4, line 24, please delete "shogun", and insert in lieu thereof --shown in--; Column 7, line 20, after "of the material", delete "con, only", and insert in lieu thereof --commonly--.

Signed and Sealed this

Ninth Day of September, 1997

*Attest:*

Bruce Lehman

BRUCE LEHMAN

*Attesting Officer*

*Commissioner of Patents and Trademarks*